US009728311B2

(12) United States Patent
Lv et al.

(10) Patent No.: US 9,728,311 B2
(45) Date of Patent: Aug. 8, 2017

(54) METHOD FOR PREPARING NEODYMIUM-IRON-BORON (ND—FE—B)-BASED SINTERED MAGNET

(71) Applicants: Ningbo Yunsheng Co., Ltd., Ningbo (CN); Ningbo Yunsheng High-Tech Magnetics Co., Ltd., Ningbo (CN); Ningbo Yunsheng Special Metal Material Co., Ltd., Ningbo (CN); Baotou Yunsheng Strong Magnetic Material Co., Ltd., Baotou (CN)

(72) Inventors: Xiangke Lv, Ningbo (CN); Min Zhang, Ningbo (CN); Xike Ouyang, Ningbo (CN); Yong Ding, Ningbo (CN); Zhao Wang, Ningbo (CN); Shengye Liu, Ningbo (CN)

(73) Assignees: NINGBO YUNSHENG CO., LTD., Ningbo (CN); NINGBO YUNSHENG HIGH-TECH MAGNETICS CO., LTD., Ningbo (CN); NINGBO YUNSHENG SPECIAL METAL MATERIAL CO., LTD., Ningbo (CN); BAOTOU YUNSHENG STRONG MAGNETIC MATERIAL CO., LTD., Baotou (CN)

( * ) Notice: Subject to any disclaimer, the term of this patent is extended or adjusted under 35 U.S.C. 154(b) by 525 days.

(21) Appl. No.: 14/542,535

(22) Filed: Nov. 14, 2014

(65) Prior Publication Data

US 2015/0071810 A1 Mar. 12, 2015

Related U.S. Application Data

(63) Continuation-in-part of application No. PCT/CN2013/000059, filed on Jan. 21, 2013.

(30) Foreign Application Priority Data

Dec. 26, 2012 (CN) ..... 2012 1 0576207

(51) Int. Cl.

| | |
|---|---|
| ***H01F 1/057*** | (2006.01) |
| ***H01F 41/02*** | (2006.01) |
| ***C22C 28/00*** | (2006.01) |
| ***C22C 38/00*** | (2006.01) |
| ***C22C 38/06*** | (2006.01) |
| ***C22C 38/16*** | (2006.01) |
| *B22F 9/02* | (2006.01) |
| *B22F 9/04* | (2006.01) |
| *B22F 3/24* | (2006.01) |

(52) U.S. Cl.

CPC ..... *H01F 1/0577* (2013.01); *C22C 28/00* (2013.01); *C22C 38/002* (2013.01); *C22C 38/005* (2013.01); *C22C 38/06* (2013.01); *C22C 38/16* (2013.01); *H01F 41/0266* (2013.01); *H01F 41/0273* (2013.01); *B22F 9/023* (2013.01); *B22F 9/04* (2013.01); *B22F 2003/248* (2013.01); *B22F 2998/10* (2013.01); *B22F 2999/00* (2013.01)

(58) Field of Classification Search

CPC ..... H01F 1/0577; H01F 41/0266

See application file for complete search history.

(56) References Cited

U.S. PATENT DOCUMENTS

2010/0003156 A1* 1/2010 Suzuki ..... B22F 1/025 419/10

* cited by examiner

*Primary Examiner* — Jessee Roe

(74) *Attorney, Agent, or Firm* — Matthias Scholl, PC; Matthias Scholl

(57) ABSTRACT

A method for preparing a Nd—Fe—B-based sintered magnet. The method includes: 1) providing a master alloy and an auxiliary alloy, the master alloy being a Nd—Fe—B alloy ingot or cast strip, the auxiliary alloy being a heavy rare earth alloy; 2) breaking up the master alloy using a hydrogen decrepitation process to yield a crude powder, conducting hydrogen absorption treatment on the auxiliary alloy and breaking up the hydrogenated auxiliary alloy to yield hydride particles; 3) uniformly mixing and stirring the crude powder of the master alloy and the hydride particles of the auxiliary alloy to yield a mixture; 4) milling the mixture obtained in step 3) to yield powders; 5) uniformly stirring the powders obtained in step 4) and conducting orientation forming treatment on the powders, to yield a raw body of a Nd—Fe—B based magnet; and 6) sintering the raw body of the Nd—Fe—B based magnet.

9 Claims, No Drawings

METHOD FOR PREPARING NEODYMIUM-IRON-BORON (ND—FE—B)-BASED SINTERED MAGNET

CROSS-REFERENCE TO RELATED APPLICATIONS

This application is a continuation-in-part of International Patent Application No. PCT/CN2013/000059 with an international filing date of Jan. 21, 2013, designating the United States, now pending, and further claims priority benefits to Chinese Patent Application No. 201210576207.4 filed Dec. 26, 2012. The contents of all of the aforementioned applications, including any intervening amendments thereto, are incorporated herein by reference.

BACKGROUND OF THE INVENTION

Field of the Invention

The invention relates to a method for preparing a Neodymium-Iron-Boron Nd—Fe—B based sintered magnet.

Description of the Related Art

Coercivity is a significant index for evaluating the magnetic properties of a Nd—Fe—B based sintered magnet, and a typical method for improving the coercivity of the magnet is to add a heavy rare earth element such as Tb and Dy during the melting process. However, the heavy rare earth element is expensive. In addition, the heavy rare earth element and iron tends to interact to produce an antiferromagnetic coupling effect, thereby reducing the saturation magnetization and the residual magnetization of the Nd—Fe—B based sintered magnet.

To improve the comprehensive magnetic performance and the coercivity of the Nd—Fe—B based sintered magnet, a dual-alloy technology is employed to control Dy to be distributed mainly in the vicinity of the grain boundary. However, the method requires pure heavy rare earth elements for the preparation of heavy rare earth hydrides, which results in high production cost. On the other hand, the heavy rare earth hydrides must be milled into superfines, which involves a complex and difficult production process, and the resulting product has poor homogeneity.

SUMMARY OF THE INVENTION

In view of the above-described problems, it is one objective of the invention to provide a method for preparing a Neodymium-Iron-Boron (Nd—Fe—B) based sintered magnet that features a simple production process and low production cost. The resulting Nd—Fe—B based sintered magnet has high coercivity and excellent comprehensive magnetic performance.

To achieve the above objective, in accordance with one embodiment of the invention, there is provided a method for preparing a Nd—Fe—B based sintered magnet, the method comprising:

1) providing a master alloy and an auxiliary alloy, the master alloy being a Nd—Fe—B alloy ingot or cast strip, the auxiliary alloy being a heavy rare earth alloy having a formula of $R_aM_bFe_{100-a-b}$, wherein R represents Gd, Tb, Dy, Ho, or a mixture thereof, M represents Co, Mn, Cu, Al, Ti, Ga, Zr, V, Hf, W, B, Nb, or a mixture thereof, a and b are both expressed in percentage by weight, $30 \le a < 100$, $0 \le b \le 70$;
2) breaking up the master alloy using a hydrogen decrepitation process to yield a crude powder, conducting hydrogen absorption treatment on the auxiliary alloy and breaking up the hydrogenated auxiliary alloy to yield hydride particles;
3) uniformly mixing and stirring the crude powder of the master alloy and the hydride particles of the auxiliary alloy to yield a mixture, wherein a weight percentage of the crude powder of the master alloy is greater than or equal to 75% and less than 100% of a total weight of the mixture, and a weight percentage of the hydride particles of the auxiliary alloy is greater than 0 and less than or equal to 25% of a total weight of the mixture;
4) milling the mixture obtained in step 3) to yield powders having a surface area mean diameter of between 1 and 5 μm;
5) uniformly stirring the powders obtained in step 4) and conducting orientation forming treatment on the powders, to yield a raw body of a Nd—Fe—B based magnet; and
6) sintering the raw body of the Nd—Fe—B based magnet.

In a class of this embodiment, the master alloy in step 1) has a formula of $Nd_mN_nX_tFe_{100-m-n-k-t}B_k$, N represents La, Ce, Pr, Dy, Tb, or a mixture thereof, X represents Co, Mn, Cu, Al, Ti, Ga, Zr, V, Hf, W, Nb, or a mixture thereof, m, n, t, and k are all expressed in percentage by weight, $28.5 \le m+n \le 33$, $0 \le t \le 5$, $0.9 \le k \le 1.2$.

In a class of this embodiment, the hydride particles in step 2) have hydrogen content by weight of being greater than or equal to 4000 ppm and less than or equal to 15000 ppm.

In a class of this embodiment, the orientation forming treatment in step 5) employs an orientation magnetic field of between 1 and 5 T.

In a class of this embodiment, a sintering process in step 6) comprises the following steps:

6-1) introducing the raw body of the Nd—Fe—B based magnet to a vacuum sintering furnace, heating the furnace from 800° C. to 1000° C. for dehydrogenation for 2 hours;

6-2) heating the vacuum sintering furnace to a temperature between 1010 and 1120° C., and sintering the raw body for between 1 and 4 hours; and 6-3) allowing the raw body for a primary tempering at 850-950° C. for between 1 and 4 hours and for a secondary tempering at 450-600° C. for between 1 and 4 hours, to yield the Nd—Fe—B based sintered magnet.

Advantages of the invention are summarized as follows. The invention employs a heavy rare earth alloy to prepare a heavy rare earth alloy hydride instead of directly adding a heavy rare earth element, thereby reducing the production cost. In addition, besides the heavy rare earth element, the heavy rare earth alloy comprises other alloy elements adapted to modify grain boundary phase thereby improving the comprehensive magnetic performance of the Nd—Fe—B based sintered magnet. On the other hand, the crude powder of the master alloy and the hydride particles of the auxiliary alloy are uniformly mixed and stirred to yield a mixture, and the mixture is milled using a jet mill. In the process of milling, the two alloys are mixed and collide with one another thereby improving the homogeneity of the Nd—Fe—B based sintered magnet. In this invention, superfines of heavy rare earth hydrides are not required to add, and thus the production process is simple. The hydride particles of the auxiliary alloy have hydrogen content by weight of being greater than or equal to 4000 ppm and less than or equal to 15000 ppm. The hydride particles are brittle, fragile, not easy to oxidize, and are adapted to mix with the master alloy for the preparation of powders.

DETAILED DESCRIPTION OF THE EMBODIMENTS

For further illustrating the invention, experiments detailing a method for preparing a Nd—Fe—B based sintered magnet are described below. It should be noted that the following examples are intended to describe and not to limit the invention.

Example 1

A method for preparing a Nd—Fe—B based sintered magnet, the method comprises:

1) Providing a master alloy and an auxiliary alloy. The master alloy was prepared using a strip casting technology, which was a Nd—Fe—B alloy cast strip. The auxiliary alloy was a Dy—Fe alloy. The master alloy comprised 32 wt. % of Nd, 1 wt. % of B, and 67 wt. % of Fe. The auxiliary alloy comprised 80 wt. % of Dy and 20 wt. % of Fe.

2) Breaking up the master alloy using a hydrogen decrepitation process to yield a crude powder, conducting hydrogen absorption treatment on the auxiliary alloy and breaking up the hydrogenated auxiliary alloy to yield hydride particles. The hydride particles had hydrogen content by weight of 4251 ppm.

3) Uniformly mixing and stirring the crude powder of the master alloy and the hydride particles of the auxiliary alloy to yield a mixture, a weight ratio of the crude powder of the master alloy to the hydride particles of the auxiliary alloy being 99:1.

4) Milling the mixture obtained in step 3) to yield powders having a surface area mean diameter of 3.22 μm.

5) Uniformly stirring the powders obtained in step 4) and conducting orientation forming treatment on the powders, to yield a raw body of a Nd—Fe—B based magnet, where the orientation forming treatment employed an orientation magnetic field of 1.6 T in the presence of nitrogen, followed by cold isostatic pressing treatment.

6) Sintering the raw body of the Nd—Fe—B based magnet.

The sintering process in step 6) comprised the following steps:

6-1) introducing the raw body of the Nd—Fe—B based magnet to a vacuum sintering furnace, heating the furnace from 800° C. to 1000° C. for dehydrogenation for 2 hours;

6-2) heating the vacuum sintering furnace to a temperature of 1070° C., and sintering the raw body for 4 hours; and 6-3) allowing the raw body for a primary tempering at 890° C. for 2 hours and for a secondary tempering at 500° C. for 4 hours, to yield the Nd—Fe—B based sintered magnet.

TABLE 1

Magnetic performance of Nd—Fe—B based sintered magnet after being added with 1 wt. % of heavy rare earth alloy ($Dy_{80}Fe_{20}$)

| Dy content (wt. %) | $B_r$ (kGs) | $H_{cB}$ (kOe) | $H_{cj}$ (kOe) | $(BH)_{max}$ (MGsOe) | $H_k$ (kOe) | $H_k/H_{cj}$ |
|---|---|---|---|---|---|---|
| 0.8 | 11.8 | 11.47 | 18.61 | 33.84 | 17.74 | 0.95 |

Example 2

A method for preparing a Nd—Fe—B based sintered magnet, the method comprises:

1) Providing a master alloy and an auxiliary alloy. The master alloy was prepared using a strip casting technology, which was a Nd—Fe—B alloy cast strip. The auxiliary alloy was a Dy—Fe alloy. The master alloy comprised 32 wt. % of Nd, 1 wt. % of B, and 67 wt. % of Fe. The auxiliary alloy comprised 80 wt. % of Dy and 20 wt. % of Fe.

2) Breaking up the master alloy using a hydrogen decrepitation process to yield a crude powder, conducting hydrogen absorption treatment on the auxiliary alloy and breaking up the hydrogenated auxiliary alloy to yield hydride particles. The hydride particles had hydrogen content by weight of 4251 ppm.

3) Uniformly mixing and stirring the crude powder of the master alloy and the hydride particles of the auxiliary alloy to yield a mixture, a weight ratio of the crude powder of the master alloy to the hydride particles of the auxiliary alloy being 97.5:2.5.

4) Milling the mixture obtained in step 3) to yield powders having a surface area mean diameter of 2.97 μm.

5) Uniformly stirring the powders obtained in step 4) and conducting orientation forming treatment on the powders, to yield a raw body of a Nd—Fe—B based magnet, where the orientation forming treatment employed an orientation magnetic field of 1.6 T in the presence of nitrogen, followed by cold isostatic pressing treatment.

6) Sintering the raw body of the Nd—Fe—B based magnet.

The sintering process in step 6) comprised the following steps:

6-1) introducing the raw body of the Nd—Fe—B based magnet to a vacuum sintering furnace, heating the furnace from 800° C. to 1000° C. for dehydrogenation for 2 hours;

6-2) heating the vacuum sintering furnace to a temperature of 1065° C., and sintering the raw body for 4 hours; and 6-3) allowing the raw body for a primary tempering at 890° C. for 2 hours and for a secondary tempering at 480° C. for 4 hours, to yield the Nd—Fe—B based sintered magnet.

TABLE 2

Magnetic performance of Nd—Fe—B based sintered magnet after being added with 2.5 wt. % of heavy rare earth alloy ($Dy_{80}Fe_{20}$)

| Dy content (wt. %) | $B_r$ (kGs) | $H_{cB}$ (kOe) | $H_{cj}$ (kOe) | $(BH)_{max}$ (MGsOe) | $H_k$ (kOe) | $H_k/H_{cj}$ |
|---|---|---|---|---|---|---|
| 2 | 11.24 | 10.96 | 21.29 | 30.77 | 20.43 | 0.96 |

Example 3

A method for preparing a Nd—Fe—B based sintered magnet, the method comprises:

1) Providing a master alloy and an auxiliary alloy. The master alloy was prepared using a strip casting technology, which was a Nd—Fe—B alloy cast strip. The auxiliary alloy was a heavy rare earth alloy ingot. The master alloy comprised 29 wt. % of Pr—Nd alloy, 1.2 wt. % of Dy, 0.98 wt. % of B, 67.82 wt. % of Fe, and 1 wt. % of Co. The auxiliary alloy comprised 69.5 wt. % of Dy, 5 wt. % of Nd, 0.8 wt. % of Ga, 0.7 wt. % of Cu, 1.6 wt. % of Al, and 22.4 wt. % of Fe.

2) Breaking up the master alloy using a hydrogen decrepitation process to yield a crude powder, conducting hydrogen absorption treatment on the auxiliary alloy and breaking up the hydrogenated auxiliary alloy to yield hydride particles. The hydride particles had hydrogen content by weight of 10840 ppm.

3) Uniformly mixing and stirring the crude powder of the master alloy and the hydride particles of the auxiliary alloy to yield a mixture, a weight ratio of the crude powder of the master alloy to the hydride particles of the auxiliary alloy being 99:1.

4) Milling the mixture obtained in step 3) to yield powders having a surface area mean diameter of 2.88 μm.

5) Uniformly stirring the powders obtained in step 4) and conducting orientation forming treatment on the powders, to yield a raw body of a Nd—Fe—B based magnet, where the orientation forming treatment employed an orientation magnetic field of 1.8 T in the presence of nitrogen, followed by cold isostatic pressing treatment.

6) Sintering the raw body of the Nd—Fe—B based magnet.

The sintering process in step 6) comprised the following steps:

6-1) introducing the raw body of the Nd—Fe—B based magnet to a vacuum sintering furnace, heating the furnace from 800° C. to 1000° C. for dehydrogenation for 2 hours;

6-2) heating the vacuum sintering furnace to a temperature of 1061° C., and sintering the raw body for 4 hours; and 6-3) allowing the raw body for a primary tempering at 890° C. for 2 hours and for a secondary tempering at 480° C. for 4 hours, to yield the Nd—Fe—B based sintered magnet.

TABLE 3

Magnetic performance of Nd—Fe—B based sintered magnet after being added with 1 wt. % of heavy rare earth alloy ($Dy_{69.5}Nd_5Ga_{0.8}Cu_{0.7}Al_{1.6}Fe_{22.4}$)

| Dy content (wt. %) | $B_r$ (kGs) | $H_{cB}$ (kOe) | $H_{cj}$ (kOe) | $(BH)_{max}$ (MGsOe) | $H_k$ (kOe) | $H_k/H_{cj}$ |
|---|---|---|---|---|---|---|
| 1.88 | 13.39 | 12.96 | 18.54 | 43.57 | 17.85 | 0.96 |

Example 4

A method for preparing a Nd—Fe—B based sintered magnet, the method comprises:

1) Providing a master alloy and an auxiliary alloy. The master alloy was prepared using a strip casting technology, which was a Nd—Fe—B alloy cast strip. The auxiliary alloy was a heavy rare earth alloy ingot. The master alloy comprised 29 wt. % of Pr—Nd alloy, 1.2 wt. % of Dy, 0.98 wt. % of B, 67.82 wt. % of Fe, and 1 wt. % of Co. The auxiliary alloy comprised 69.5 wt. % of Dy, 5 wt. % of Nd, 0.8 wt. % of Ga, 0.7 wt. % of Cu, 1.6 wt. % of Al, and 22.4 wt. % of Fe.

2) Breaking up the master alloy using a hydrogen decrepitation process to yield a crude powder, conducting hydrogen absorption treatment on the auxiliary alloy and breaking up the hydrogenated auxiliary alloy to yield hydride particles. The hydride particles had hydrogen content by weight of 10840 ppm.

3) Uniformly mixing and stirring the crude powder of the master alloy and the hydride particles of the auxiliary alloy to yield a mixture, a weight ratio of the crude powder of the master alloy to the hydride particles of the auxiliary alloy being 97.3:2.7.

4) Milling the mixture obtained in step 3) to yield powders having a surface area mean diameter of 2.56 μm.

5) Uniformly stirring the powders obtained in step 4) and conducting orientation forming treatment on the powders, to yield a raw body of a Nd—Fe—B based magnet, where the orientation forming treatment employed an orientation magnetic field of 1.8 T in the presence of nitrogen, followed by cold isostatic pressing treatment.

6) Sintering the raw body of the Nd—Fe—B based magnet.

The sintering process in step 6) comprised the following steps:

6-1) introducing the raw body of the Nd—Fe—B based magnet to a vacuum sintering furnace, heating the furnace from 800° C. to 1000° C. for dehydrogenation for 2 hours;

6-2) heating the vacuum sintering furnace to a temperature of 1030° C., and sintering the raw body for 4 hours; and 6-3) allowing the raw body for a primary tempering at 890° C. for 2 hours and for a secondary tempering at 450° C. for 4 hours, to yield the Nd—Fe—B based sintered magnet.

TABLE 4

Magnetic performance of Nd—Fe—B based sintered magnet after being added with 2.7 wt. % of heavy rare earth alloy ($Dy_{69.5}Nd_5Ga_{0.8}Cu_{0.7}Al_{1.6}Fe_{22.4}$)

| Dy content (wt. %) | $B_r$ (kGs) | $H_{cB}$ (kOe) | $H_{cj}$ (kOe) | $(BH)_{max}$ (MGsOe) | $H_k$ (kOe) | $H_k/H_{cj}$ |
|---|---|---|---|---|---|---|
| 3.04 | 12.71 | 12.34 | 22.69 | 39.46 | 21.69 | 0.96 |

Example 5

A method for preparing a Nd—Fe—B based sintered magnet, the method comprises:

1) Providing a master alloy and an auxiliary alloy. The master alloy was prepared using a strip casting technology, which was a Nd—Fe—B alloy cast strip. The auxiliary alloy was a heavy rare earth alloy cast strip. The master alloy comprised 29.3 wt. % of Pr—Nd alloy, 0.2 wt. % of Nb, 1 wt. % of Co, 0.1 wt. % of Al, 0.15 wt. % of Cu, 1 wt. % of B, and 68.25 wt. % of Fe. The auxiliary alloy comprised 55 wt. % of Dy, 0.1 wt. % of Ga, 0.15 wt. % of Cu, 0.3 wt. % of Al, 1.4 wt. % of B, and 43.05 wt. % of Fe.

2) Breaking up the master alloy using a hydrogen decrepitation process to yield a crude powder, conducting hydrogen absorption treatment on the auxiliary alloy and breaking up the hydrogenated auxiliary alloy to yield hydride particles. The hydride particles had hydrogen content by weight of 8086 ppm.

3) Uniformly mixing and stirring the crude powder of the master alloy and the hydride particles of the auxiliary alloy to yield a mixture, a weight ratio of the crude powder of the master alloy to the hydride particles of the auxiliary alloy being 92.2:7.8.

4) Milling the mixture obtained in step 3) to yield powders having a surface area mean diameter of 2.44 μm.

5) Uniformly stirring the powders obtained in step 4) and conducting orientation forming treatment on the powders, to yield a raw body of a Nd—Fe—B based magnet, where the orientation forming treatment employed an orientation magnetic field of 1.8 T in the presence of nitrogen, followed by cold isostatic pressing treatment.

6) Sintering the raw body of the Nd—Fe—B based magnet.

The sintering process in step 6) comprised the following steps:

6-1) introducing the raw body of the Nd—Fe—B based magnet to a vacuum sintering furnace, heating the furnace from 800° C. to 1000° C. for dehydrogenation for 2 hours;

6-2) heating the vacuum sintering furnace to a temperature of 1030° C., and sintering the raw body for 4 hours; and 6-3) allowing the raw body for a primary tempering at 890° C. for 2 hours and for a secondary tempering at 500° C. for 4 hours, to yield the Nd—Fe—B based sintered magnet.

TABLE 5

Magnetic performance of Nd—Fe—B based sintered magnet after being added with 7.8 wt. % of heavy rare earth alloy ($Dy_{55}Ga_{0.1}Cu_{0.15}Al_{0.3}Fe_{43.05}B_{1.4}$)

| Dy content (wt. %) | $B_r$ (kGs) | $H_{cB}$ (kOe) | $H_{cj}$ (kOe) | $(BH)_{max}$ (MGsOe) | $H_k$ (kOe) | $H_k/H_{cj}$ |
|---|---|---|---|---|---|---|
| 4.3 | 12.82 | 12.49 | 23.70 | 40.19 | 22.43 | 0.95 |

Example 6

A method for preparing a Nd—Fe—B based sintered magnet, the method comprises:

1) Providing a master alloy and an auxiliary alloy. The master alloy was prepared using a strip casting technology, which was a Nd—Fe—B alloy cast strip. The auxiliary alloy was a heavy rare earth alloy cast strip. The master alloy comprised 29.3 wt. % of Pr—Nd alloy, 0.2 wt. % of Nb, 1 wt. % of Co, 0.1 wt. % of Al, 0.15 wt. % of Cu, 1 wt. % of B, and 68.25 wt. % of Fe. The auxiliary alloy comprised 45 wt. % of Dy, 0.1 wt. % of Ga, 0.15 wt. % of Cu, 0.3 wt. % of Al, 1.4 wt. % of B, and 53.05 wt. % of Fe.

2) Breaking up the master alloy using a hydrogen decrepitation process to yield a crude powder, conducting hydrogen absorption treatment on the auxiliary alloy and breaking up the hydrogenated auxiliary alloy to yield hydride particles. The hydride particles had hydrogen content by weight of 8911 ppm.

3) Uniformly mixing and stirring the crude powder of the master alloy and the hydride particles of the auxiliary alloy to yield a mixture, a weight ratio of the crude powder of the master alloy to the hydride particles of the auxiliary alloy being 85.1:14.9.

4) Milling the mixture obtained in step 3) to yield powders having a surface area mean diameter of 2.49 μm.

5) Uniformly stirring the powders obtained in step 4) and conducting orientation forming treatment on the powders, to yield a raw body of a Nd—Fe—B based magnet, where the orientation forming treatment employed an orientation magnetic field of 1.8 T in the presence of nitrogen, followed by cold isostatic pressing treatment.

6) Sintering the raw body of the Nd—Fe—B based magnet.

The sintering process in step 6) comprised the following steps:

6-1) introducing the raw body of the Nd—Fe—B based magnet to a vacuum sintering furnace, heating the furnace from 800° C. to 1000° C. for dehydrogenation for 2 hours;

6-2) heating the vacuum sintering furnace to a temperature of 1030° C., and sintering the raw body for 4 hours; and 6-3) allowing the raw body for a primary tempering at 890° C. for 2 hours and for a secondary tempering at 530° C. for 4 hours, to yield the Nd—Fe—B based sintered magnet.

TABLE 6

Magnetic performance of Nd—Fe—B based sintered magnet after being added with 14.9 wt. % of heavy rare earth alloy ($Dy_{45}Ga_{0.1}Cu_{0.15}Al_{0.3}Fe_{53.05}B_{1.4}$)

| Dy content (wt. %) | $B_r$ (kGs) | $H_{cB}$ (kOe) | $H_{cj}$ (kOe) | $(BH)_{max}$ (MGsOe) | $H_k$ (kOe) | $H_k/H_{cj}$ |
|---|---|---|---|---|---|---|
| 6.7 | 11.24 | 10.86 | 30.04 | 31.15 | 29.14 | 0.97 |

Example 7

A method for preparing a Nd—Fe—B based sintered magnet, the method comprises:

1) Providing a master alloy and an auxiliary alloy. The master alloy was prepared using a strip casting technology, which was a Nd—Fe—B alloy cast strip. The auxiliary alloy was a heavy rare earth alloy cast strip. The master alloy comprised 29.3 wt. % of Pr—Nd alloy, 0.2 wt. % of Nb, 1 wt. % of Co, 0.1 wt. % of Al, 0.15 wt. % of Cu, 1 wt. % of B, and 68.25 wt. % of Fe. The auxiliary alloy comprised 35 wt. % of Dy, 0.1 wt. % of Ga, 0.15 wt. % of Cu, 0.3 wt. % of Al, 1.4 wt. % of B, and 63.05 wt. % of Fe.

2) Breaking up the master alloy using a hydrogen decrepitation process to yield a crude powder, conducting hydrogen absorption treatment on the auxiliary alloy and breaking up the hydrogenated auxiliary alloy to yield hydride particles. The hydride particles had hydrogen content by weight of 7423 ppm.

3) Uniformly mixing and stirring the crude powder of the master alloy and the hydride particles of the auxiliary alloy to yield a mixture, a weight ratio of the crude powder of the master alloy to the hydride particles of the auxiliary alloy being 75:25.

4) Milling the mixture obtained in step 3) to yield powders having a surface area mean diameter of 2.51 μm.

5) Uniformly stirring the powders obtained in step 4) and conducting orientation forming treatment on the powders, to yield a raw body of a Nd—Fe—B based magnet, where the orientation forming treatment employed an orientation magnetic field of 1.8 T in the presence of nitrogen, followed by cold isostatic pressing treatment.

6) Sintering the raw body of the Nd—Fe—B based magnet.

The sintering process in step 6) comprised the following steps:

6-1) introducing the raw body of the Nd—Fe—B based magnet to a vacuum sintering furnace, heating the furnace from 800° C. to 1000° C. for dehydrogenation for 2 hours;

6-2) heating the vacuum sintering furnace to a temperature of 1030° C., and sintering the raw body for 4 hours; and 6-3) allowing the raw body for a primary tempering at 890° C. for 2 hours and for a secondary tempering at 530° C. for 4 hours, to yield the Nd—Fe—B based sintered magnet.

TABLE 7

Magnetic performance of Nd—Fe—B based sintered magnet after being added with 25 wt. % of heavy rare earth alloy ($Dy_{35}Ga_{0.1}Cu_{0.15}Al_{0.3}Fe_{63.05}B_{1.4}$)

| Dy content (wt. %) | $B_r$ (kGs) | $H_{cB}$ (kOe) | $H_{cj}$ (kOe) | $(BH)_{max}$ (MGsOe) | $H_k$ (kOe) | $H_k/H_{cj}$ |
|---|---|---|---|---|---|---|
| 8.75 | 11.10 | 10.77 | 32.43 | 30.40 | 31.45 | 0.97 |

Unless otherwise indicated, the numerical ranges involved in the invention include the end values.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A method for preparing a Neodymium-Iron-Boron (Nd—Fe—B) based sintered magnet, the method comprising:

1) providing a master alloy and an auxiliary alloy, the master alloy being a Nd—Fe—B alloy ingot or cast strip, the auxiliary alloy being a heavy rare earth alloy having a formula of $R_aM_bFe_{100-a-b}$, wherein R represents Gd, Tb, Dy, Ho, or a mixture thereof, M represents Co, Mn, Cu, Al, Ti, Ga, Zr, V, Hf, W, B, Nb, or a mixture thereof, a and b are both expressed in percentage by weight, $30 \leq a < 100$, $0 \leq b < 70$;

2) breaking up the master alloy using a hydrogen decrepitation process to yield a crude powder, conducting hydrogen absorption treatment on the auxiliary alloy and breaking up the hydrogenated auxiliary alloy to yield hydride particles;

3) uniformly mixing and stirring the crude powder of the master alloy and the hydride particles of the auxiliary alloy to yield a mixture, wherein a weight percentage of the crude powder of the master alloy is greater than or equal to 75% and less than 100% of a total weight of the mixture, and a weight percentage of the hydride particles of the auxiliary alloy is greater than 0 and less than or equal to 25% of a total weight of the mixture;

4) milling the mixture obtained in step 3) to yield powders having a surface area mean diameter of between 1 and 5 μm;

5) uniformly stirring the powders obtained in step 4) and conducting orientation forming treatment on the powders, to yield a raw body of a Nd—Fe—B based magnet; and 6) sintering the raw body of the Nd—Fe—B based magnet.

2. The method of claim 1, wherein the orientation forming treatment in step 5) employs an orientation magnetic field of between 1 and 5 T.

3. The method of claim 1, wherein a sintering process in step 6) comprises the following steps:

6-1) introducing the raw body of the Nd—Fe—B based magnet to a vacuum sintering furnace, heating the furnace from 800° C. to 1000° C. for dehydrogenation for 2 hours;

6-2) heating the vacuum sintering furnace to a temperature between 1010 and 1120° C., and sintering the raw body for between 1 and 4 hours; and 6-3) allowing the raw body for a primary tempering at 850-950° C. for between 1 and 4 hours and for a secondary tempering at 450-600° C. for between 1 and 4 hours, to yield the Nd—Fe—B based sintered magnet.

4. The method of claim 1, wherein the master alloy in step 1) has a formula of $Nd_mN_nX_tFe_{100-m-n-k-t}B_k$, N represents La, Ce, Pr, Dy, Tb, or a mixture thereof, X represents Co, Mn, Cu, Al, Ti, Ga, Zr, V, Hf, W, Nb, or a mixture thereof, m, n, t, and k are all expressed in percentage by weight, $28.5 \leq m+n \leq 33$, $0 \leq t \leq 5$, $0.9 \leq k \leq 1.2$.

5. The method of claim 4, wherein the orientation forming treatment in step 5) employs an orientation magnetic field of between 1 and 5 T.

6. The method of claim 4, wherein a sintering process in step 6) comprises the following steps:

6-1) introducing the raw body of the Nd—Fe—B based magnet to a vacuum sintering furnace, heating the furnace from 800° C. to 1000° C. for dehydrogenation for 2 hours;

6-2) heating the vacuum sintering furnace to a temperature between 1010 and 1120° C., and sintering the raw body for between 1 and 4 hours; and 6-3) allowing the raw body for a primary tempering at 850-950° C. for between 1 and 4 hours and for a secondary tempering at 450-600° C. for between 1 and 4 hours, to yield the Nd—Fe—B based sintered magnet.

7. The method of claim 1, wherein the hydride particles in step 2) have hydrogen content by weight of being greater than or equal to 4000 ppm and less than or equal to 15000 ppm.

8. The method of claim 7, wherein the orientation forming treatment in step 5) employs an orientation magnetic field of between 1 and 5 T.

9. The method of claim 7, wherein a sintering process in step 6) comprises the following steps:

6-1) introducing the raw body of the Nd—Fe—B based magnet to a vacuum sintering furnace, heating the furnace from 800° C. to 1000° C. for dehydrogenation for 2 hours;

6-2) heating the vacuum sintering furnace to a temperature between 1010 and 1120° C., and sintering the raw body for between 1 and 4 hours; and 6-3) allowing the raw body for a primary tempering at 850-950° C. for between 1 and 4 hours and for a secondary tempering at 450-600° C. for between 1 and 4 hours, to yield the Nd—Fe—B based sintered magnet.

* * * * *